US007253787B2

(12) United States Patent
Liu et al.

(10) Patent No.: US 7,253,787 B2
(45) Date of Patent: Aug. 7, 2007

(54) HELIX ANTENNA AND METHOD FOR MANUFACTURING THE SAME

(75) Inventors: Kuo-Cheng Liu, Xindian (TW); Chin-Hon Fan, Xindian (TW); Kun-Ting Lin, Xindian (TW); Ren-Peng Chen, Xindian (TW)

(73) Assignee: High Tech Computer, Corp., Taoyuan (TW)

( * ) Notice: Subject to any disclaimer, the term of this patent is extended or adjusted under 35 U.S.C. 154(b) by 177 days.

(21) Appl. No.: 11/099,616

(22) Filed: Apr. 6, 2005

(65) Prior Publication Data

US 2006/0109196 A1 May 25, 2006

(30) Foreign Application Priority Data

Nov. 25, 2004 (TW) ..... 93136269 A

(51) Int. Cl.
*H01Q 1/36* (2006.01)

(52) U.S. Cl. ..... 343/895

(58) Field of Classification Search ..... 343/700 MS, 343/725, 829, 846, 853, 895
See application file for complete search history.

(56) References Cited

U.S. PATENT DOCUMENTS 5,828,348 A * 10/1998 Tassoudji et al. ..... 343/895
6,184,844 B1 * 2/2001 Filipovic et al. ..... 343/895
6,184,845 B1 * 2/2001 Leisten et al. ..... 343/895
2002/0140622 A1 10/2002 Park et al.

FOREIGN PATENT DOCUMENTS

| | | |
|---|---|---|
| EP | 0 791 978 A | 8/1997 |
| JP | 4-220165 A | 3/1994 |
| JP | 6-212477 A | 3/1996 |
| JP | 2001-168631 A | 6/2001 |
| WO | WO 98/44590 A | 10/1998 |

* cited by examiner

*Primary Examiner*—Shih-Chao Chen
(74) *Attorney, Agent, or Firm*—Birch, Stewart, Kolasch & Birch, LLP

(57) ABSTRACT

A method for manufacturing a helix antenna. A ceramic cylinder including a central through hole, a first annular surface, and a second annular surface is provided. The first annular surface is opposite the second annular surface. The central through hole is between the first and second annular surfaces. A flexible printed circuit board with a metal feeding strip extending outside the flexible printed circuit board is provided. The flexible printed circuit board is swirled and attached to the circumferential surface of the ceramic cylinder.

20 Claims, 4 Drawing Sheets

HELIX ANTENNA AND METHOD FOR MANUFACTURING THE SAME

BACKGROUND

The invention relates to a method for manufacturing a helix antenna, and in particular to a method reducing manufacturing costs of a helix antenna.

Japan Patent. No. 2001-168631 discloses a conventional method for manufacturing a helix antenna providing a frequency of circularly polarized radiation exceeding 200 MHz. As shown in FIG. 1A, a metal (copper) layer 2 is coated (electroplated) on the outer surface of a solid ceramic cylinder 1 in which a central through hole 3 is formed. The metal (copper) layer 2 of the solid ceramic cylinder 1 is etched by a laser etching system (not shown), thereby providing a specific profile as shown in FIG. 1B. As shown in FIG. 1C, a coaxial cable 4 with an exposed copper core 41 is disposed in the central through hole 3 of the solid ceramic cylinder 1. The copper core 41 is then bent and welded to the metal (copper) layer 2 on the top of the solid ceramic cylinder 1, thereby achieving electrical connection between the coaxial cable 4 and the metal (copper) layer 2. At this point, the copper core 41 serves as a feeder. Accordingly, as the solid ceramic cylinder 1 is three-dimensional, the metal (copper) layer 2 cannot be precisely etched to form the specific profile by the laser etching system. Thus, some parameters, such as radio frequency (RF) and impedance matching, of the helix antenna cannot be obtained as required. A test and adjustment device (not shown) must then be applied to fine tune the parameters of the helix antenna.

The following description is directed to the steps of fine tuning the parameters of the helix antenna.

The helix antenna shown in FIG. 1C is connected to the test and adjustment device. Multiple probes of the test and adjustment device are coupled to the helix antenna, detecting magnitude of relative phases and amplitude of electric currents in some specific positions of the helix antenna. According to the detection of the probes, the laser etching system etches the metal (copper) layer 2 on the top of the solid ceramic cylinder 1, forming a plurality of openings 21, as shown in FIG. 1D. Specifically, to fine tune inductance of the helix antenna, the positions, profiles, and sizes of the openings 21 must be carefully arranged, thereby providing the helix antenna with a frequency of circularly polarized radiation exceeding 200 MHz.

A few drawbacks, however, exist in the process of manufacturing the aforementioned helix antenna. Bending and welding the copper core 41 to the metal (copper) layer 2 on the top of the solid ceramic cylinder 1 increases manufacturing time and causes inconvenience. Moreover, the laser etching system is very expensive and laser heads thereof must be replaced after 1500 hours, thereby increasing manufacturing costs of the helix antenna. Additionally, the duration for which the metal (copper) layer 2 is etched by the laser etching system is lengthy. Furthermore, as errors occur during etching of the metal (copper) layer 2 with the specific profile by the laser etching system, the helix antenna must be fine tuned by the test and adjustment device and laser etching system. Namely, the metal (copper) layer 2 on the top of the solid ceramic cylinder 1 is etched and the openings 21 are formed thereon. Accordingly, the process of fine tuning the helix antenna increases manufacturing time and costs thereof.

Hence, there is a need for an improved method for manufacturing a helix antenna. The method is simplified and can reduce manufacturing time and costs of the helix antenna. The method can thus be applied to mass production of the helix antenna.

SUMMARY

Accordingly, an exemplary embodiment of the invention provides a method for manufacturing a helix antenna. The method comprises the steps of providing a ceramic cylinder comprising a central through hole, a first annular surface, and a second annular surface, wherein the first annular surface is opposite the second annular surface, and the central through hole is between the first and second annular surfaces; providing a flexible printed circuit board comprising a metal feeding strip extending outside the flexible printed circuit board; and swirling and attaching the flexible printed circuit board to the circumferential surface of the ceramic cylinder.

In an embodiment of the method for manufacturing a helix antenna, the method further comprises a step of passing the metal feeding strip through the central through hole from the first annular surface to the second annular surface of the ceramic cylinder.

In an embodiment of the method for manufacturing a helix antenna, the flexible printed circuit board further comprises a metal grounding strip extending outside the flexible printed circuit board.

In an embodiment of the method for manufacturing a helix antenna, the method further comprises a step of passing the metal grounding strip through the central through hole from the first annular surface to the second annular surface of the ceramic cylinder.

In an embodiment of the method for manufacturing a helix antenna, the length of the flexible printed circuit board equals the circumference of the ceramic cylinder, and the width of the flexible printed circuit board equals the height of the ceramic cylinder.

In an embodiment of the method for manufacturing a helix antenna, the flexible printed circuit board further comprises at least one first metal strip and at least one second metal strip parallel thereto, the first and second metal strips tilt to one side of the flexible printed circuit board at a predetermined angle, the metal feeding strip is connected to the first metal strip, and the metal grounding strip is connected to the second metal strip.

In an embodiment of the method for manufacturing a helix antenna, the first and second metal strips are electroplated or printed on the flexible printed circuit board.

In an embodiment of the method for manufacturing a helix antenna, the flexible printed circuit board provides a specific value of impedance matching.

Another exemplary embodiment of the invention provides a helix antenna comprising a ceramic cylinder and a flexible printed circuit board. The ceramic cylinder comprises a central through hole, a first annular surface, and a second annular surface. The first annular surface is opposite the second annular surface. The central through hole is between the first and second annular surfaces. The flexible printed circuit board is swirled and attached to the circumferential surface of the ceramic cylinder. The flexible printed circuit board comprises a metal feeding strip extending outside the flexible printed circuit board and through the central through hole from the first annular surface to the second annular surface.

Further scope of the applicability of the present invention will become apparent from the detailed description given hereinafter. However, it should be understood that the detailed description and specific examples, while indicating preferred embodiments of the invention, are given by way of illustration only since various changes and modifications within the spirit and scope of the invention will become apparent to those skilled in the art from this detailed description.

DESCRIPTION OF THE DRAWINGS

The present invention will become more fully understood from the detailed description given hereinbelow and the accompanying drawings which arc given by way of illustration only, and thus are not limitative of the present invention, and wherein.

The invention can be more fully understood by reading the subsequent detailed description and examples with references made to the accompanying drawings, wherein.

DETAILED DESCRIPTION

Figure 2A:
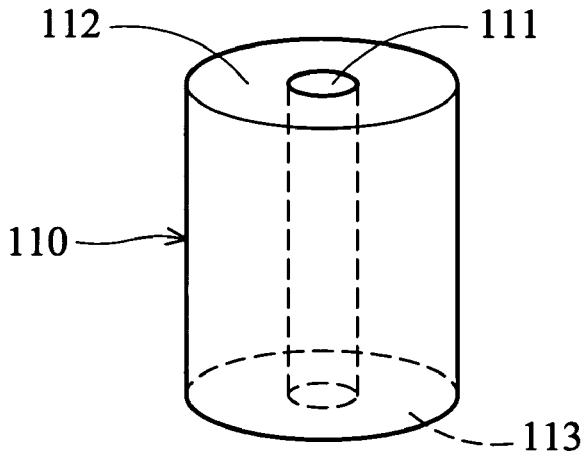
FIG. 2A is a schematic perspective view of the ceramic cylinder of the helix antenna of an embodiment of the invention.

Referring to FIG. 2A, a ceramic cylinder 110 is provided. The ceramic cylinder 110 comprises a central through hole 111, a first annular surface 112, and a second annular surface 113. The first annular surface 112 is opposite the second annular surface 113. The central through hole 111 is between the first annular surface 112 and the second annular surface 113.

Figure 2B:
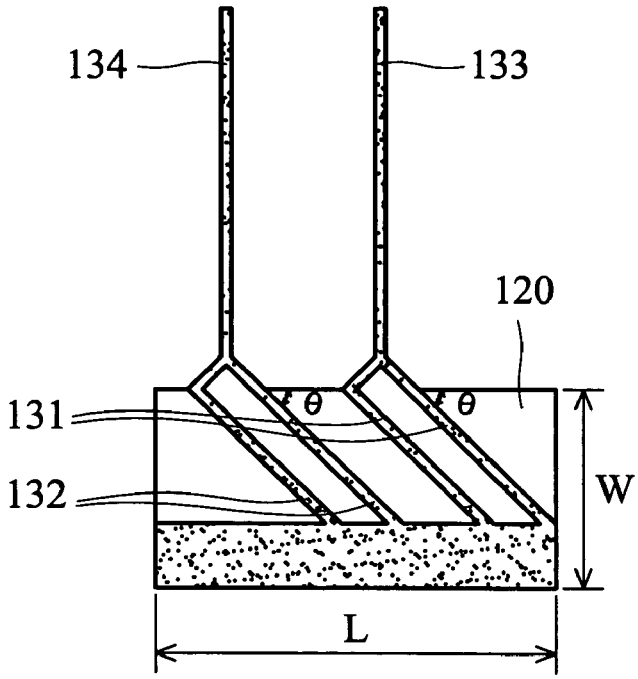
FIG. 2B is a schematic plane view of the flexible printed circuit board of the helix antenna of an embodiment of the invention.

Referring to FIG. 2B, a flexible printed circuit board (FPCB) 120, the parameters of which are finely tuned, is provided. Namely, some parameters, such as radio frequency (RF) and impedance matching, are finely tuned in the flexible printed circuit board 120. In this embodiment, the impedance matching of the flexible printed circuit board 120 is 50Ω when the receiving frequency is 1575.42 MHz.

As shown in FIG. 2B, the length L of the flexible printed circuit board 120 equals the circumference of the ceramic cylinder 110, first annular surface 112, or second annular surface 113. The width W of the flexible printed circuit board 120 equals the height of the ceramic cylinder 110.

The flexible printed circuit board 120 comprises two first metal strips 131, two second metal strips 132, a metal feeding strip 133, and a metal grounding strip 134. The first metal strips 131 are parallel to the second metal strips 132. Specifically, the first metal strips 131 and second metal strips 132 tilt to one side of the flexible printed circuit board 120 at a predetermined angle θ. The metal feeding strip 133 is connected to the first metal strips 131 and extends outside the flexible printed circuit board 120. The metal grounding strip 134 is connected to the second metal strips 132 and extends outside the flexible printed circuit board 120.

Figure 3:
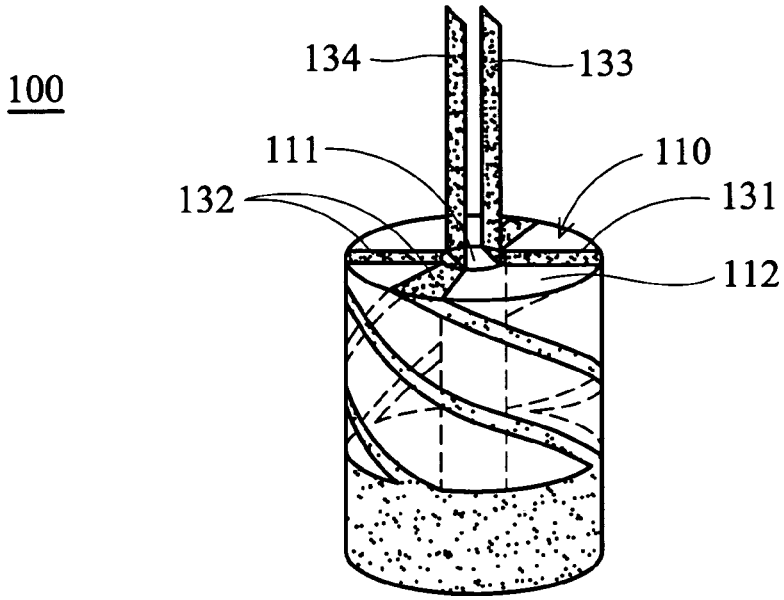
FIG. 3 is a schematic view showing assembly of the helix antenna of an embodiment of the invention.
Figure 4:
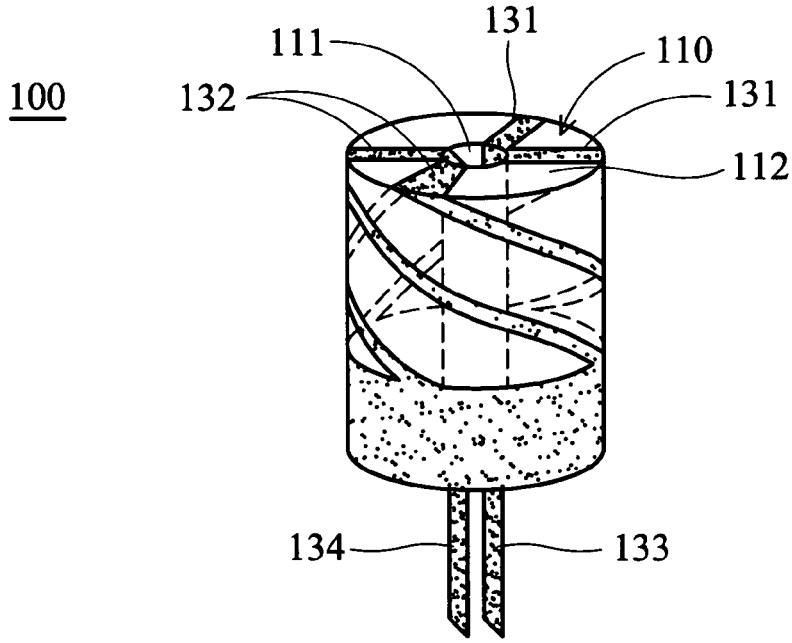
FIG. 4 is a schematic perspective view of the helix antenna of an embodiment of the invention.

Referring to FIG. 3, the flexible printed circuit board 120 is swirled and attached to the circumferential surface of the ceramic cylinder 110. At this point, the metal feeding strip 133 and metal grounding strip 134 are above the first annular surface 112 of the ceramic cylinder 110. As shown in FIG. 2A and FIG. 4, the metal feeding strip 133 and metal grounding strip 134 pass through the central through hole 111 from the first annular surface 112 to the second annular surface 113. At this point, assembly of a helix antenna 100 is complete. Specifically, as tilting to one side of the flexible printed circuit board 120 at a predetermined angle θ, the first metal strips 131 and second metal strips 132 helically surround the ceramic cylinder 110 after the flexible printed circuit board 120 is swirled and attached to the circumferential surface of the ceramic cylinder 110.

Additionally, the first metal strips 131 and second metal strips 132 can be electroplated or printed on the flexible printed circuit board 120. Alternatively, the flexible printed circuit board 120 can be formed by electroplating or printing the first metal strips 131 and second metal strips 132 on a substrate.

Figure 1A:
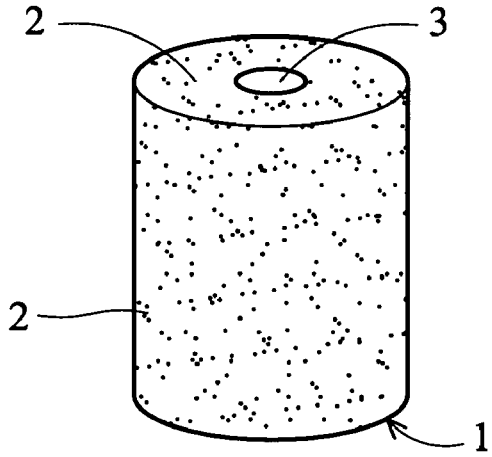
FIG. 1A ( RELATED ART )
FIG. 1A is a schematic perspective view showing the manufacturing process of a conventional helix antenna.
Figure 1B:
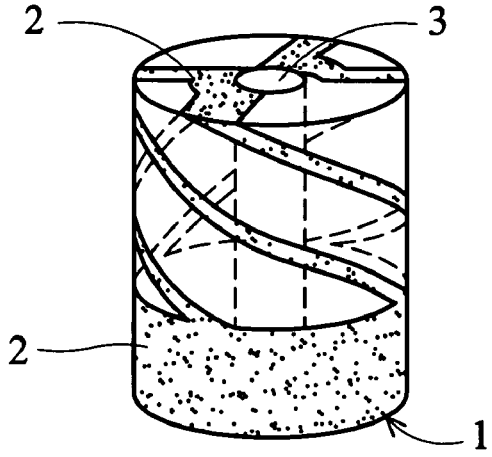
FIG. 1B ( RELATED ART )
FIG. 1B is a schematic perspective view showing the manufacturing process of the conventional helix antenna of FIG. 1A.
Figure 1C:
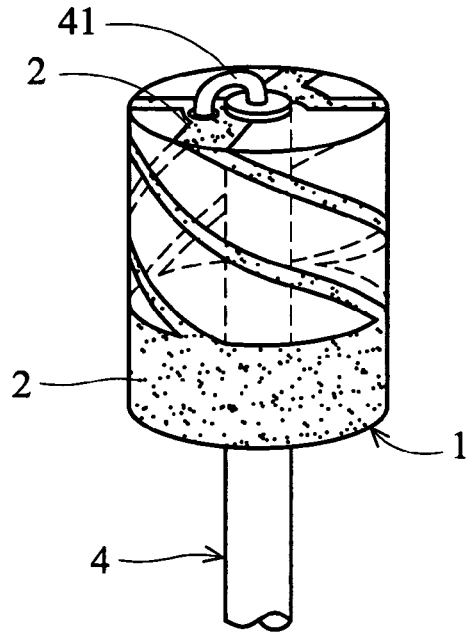
FIG. 1C ( RELATED ART )
FIG. 1C is a schematic perspective view showing the manufacturing process of the conventional helix antenna of FIG. 1B.
Figure 1D:
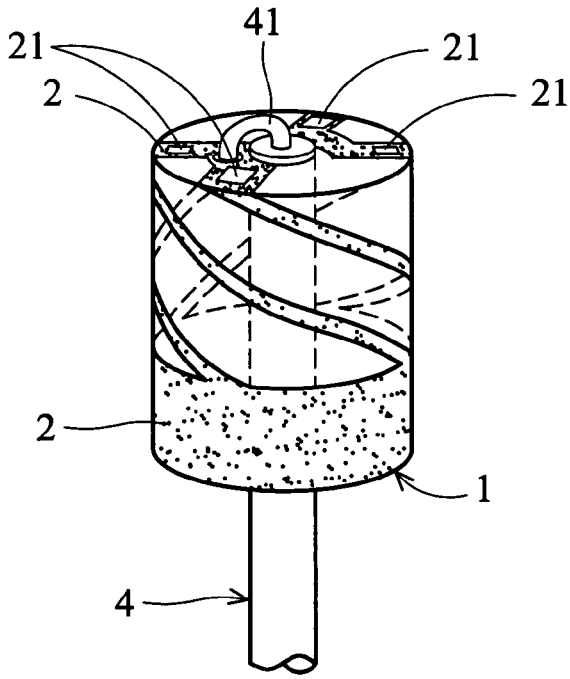
FIG. 1D ( RELATED ART )
FIG. 1D is a schematic perspective view showing the manufacturing process of the conventional helix antenna of FIG. 1C.

In conclusion, the disclosed method for manufacturing the helix antenna 100 has the following advantages. The disclosed method does not require the process of bending and welding the copper core 41 to the metal (copper) layer 2 on the top of the solid ceramic cylinder 1, as shown in FIG. 1C and FIG. 1D, thus reducing manufacturing time and complexity. Moreover, the laser etching system and test and adjustment device are not required, such that manufacturing costs of the helix antenna 100 are reduced. Additionally, as important parameters in the flexible printed circuit board 120 are finely tuned before the flexible printed circuit board 120 is swirled and attached to the circumferential surface of the ceramic cylinder 110, fine-tuning operation of the parameters performed by the laser etching system and test and adjustment device is not required, further reducing the manufacturing costs and time of the helix antenna 100. Furthermore, as unity exists in the flexible printed circuit board(s) 120, mass production of the helix antenna 100 is available, thereby enhancing productivity.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method for manufacturing a helix antenna, comprising:

providing a ceramic cylinder comprising a central through hole, a first annular surface, and a second annular surface, wherein the first annular surface is opposite the second annular surface, and the central through hole is between the first and second annular surfaces;

providing a flexible printed circuit board comprising a metal feeding strip extending outside the flexible printed circuit board;

swirling and attaching the flexible printed circuit board to the circumferential surface of the ceramic cylinder; and passing the metal feeding strip through the central through hole from the first annular surface to the second annular surface of the ceramic cylinder.

2. The method as claimed in claim 1, wherein the flexible printed circuit board father comprises a metal grounding strip extending outside the flexible printed circuit board.

3. The method as claimed in claim 2, further comprising:

passing the metal grounding strip through the central through hole from the first annular surface to the second annular surface of the ceramic cylinder.

4. The method as claimed in claim 2, wherein the length of the flexible printed circuit board equals the circumference of the ceramic cylinder, and the width of the flexible printed circuit board equals the height of the ceramic cylinder.

5. The method as claimed in claim 4, wherein the flexible printed circuit board further comprises at least one first metal strip and at least one second metal strip parallel thereto, the first and second metal strips tilt to one side of the flexible printed circuit board at a predetermined angle, the metal feeding strip is connected to the first metal strip, and the metal grounding strip is connected to the second metal strip.

6. The method as claimed in claim 5, wherein the first and second metal strips are electroplated on the flexible printed circuit board.

7. The method as claimed in claim 5, wherein the first and second metal strips are printed on the flexible printed circuit board.

8. The method as claimed in claim 1, wherein the flexible printed circuit board provides a specific value of impedance matching.

9. The method as claimed in claim 1, wherein the length of the flexible printed circuit board equals the circumference of the ceramic cylinder, and the width of the flexible printed circuit board equals the height of the ceramic cylinder.

10. The method as claimed in claim 2, wherein the flexible printed circuit board further comprises at least one first metal strip and at least one second metal strip parallel thereto, the first and second metal strips tilt to one side of the flexible printed circuit board at a predetermined angle, the metal feeding strip is connected to the first metal strip, and the metal grounding suip is connected to the second metal strip.

11. A helix antenna, comprising:

a ceramic cylinder comprising a central through hole, a first annular surface, and a second annular surface, wherein the first annular surface is opposite the second annular surface, and the central through hole is between the first and second annular surfaces; and a flexible printed circuit board swirled and attached to the circumferential surface of the ceramic cylinder, wherein the flexible printed circuit board comprises a metal feeding strip extending outside the flexible printed circuit board and through the central through hole from the first annular surface to the second annular surface.

12. The helix antenna as claimed in claim 11, wherein the flexible printed circuit board further comprises a metal grounding strip extending outside the flexible printed circuit board and through the central through hole from the first annular surface to the second annular surface.

13. The helix antenna as claimed in claim 12, wherein the length of the flexible printed circuit board equals the circumference of the ceramic cylinder, and the width of the flexible printed circuit board equals the height of the ceramic cylinder.

14. The helix antenna as claimed in claim 13, wherein the flexible printed circuit board further comprises at least one first metal strip and at least one second metal strip parallel thereto, the first and second metal strips tilt to one side of the flexible printed circuit board at a predetermined angle, the metal feeding strip is connected to the first metal strip, and the metal grounding strip is connected to the second metal strip.

15. The helix antenna as claimed in claim 14, wherein the first and second metal strips are electroplated on the flexible printed circuit board.

16. The helix antenna as claimed in claim 14, wherein the first and second metal strips are printed on the flexible printed circuit board.

17. The helix antenna as claimed in claim 11, wherein the flexible printed circuit board provides a specific value of impedance matching.

18. The helix antenna as claimed in claim 11, wherein the length of the flexible printed circuit board equals the circumference of the ceramic cylinder, and the width of the flexible printed circuit board equals the height of the ceramic cylinder.

19. The helix antenna as claimed in claim 12, wherein the flexible printed circuit board further comprises at least one first metal strip and at least one second metal strip parallel thereto, the first and second metal strips tilt to one side of the flexible printed circuit board at a predetermined angle, the metal feeding strip is connected to the first metal strip, and the metal grounding strip is connected to the second metal strip.

20. A helix antenna, comprising:

a ceramic cylinder comprising a central through hole, a first annular surface, and a second annular surface, wherein the first annular surface is opposite the second annular surface, and the central through hole is between the first and second annular surfaces; and a flexible printed circuit board swirled and attached to the circumferential surface of the ceramic cylinder, wherein the flexible printed circuit board comprises a metal feeding strip and a metal grounding strip, and the metal feeding strip and metal grounding strip extend outside the flexible printed circuit board and through the central through hole from the first annular surface to the second annular surface, respectively.

* * * * *